United States Patent [19]

Patrician et al.

[11] Patent Number: 4,859,236

[45] Date of Patent: Aug. 22, 1989

[54] PROCESS FOR PRODUCING MOLYBDENUM-RUTHENIUM METAL POWDER

[75] Inventors: Thomas J. Patrician, Monroeton; Joseph E. Ritsko, Towanda; Harry D. Martin, III, Troy, all of Pa.

[73] Assignee: GTE Products Corporation, Stamford, Conn.

[21] Appl. No.: 185,644

[22] Filed: Apr. 25, 1988

[51] Int. Cl.[4] ..... B22F 9/20

[52] U.S. Cl. ..... 75/0.5 AB; 420/429

[58] Field of Search ..... 75/0.5 AB; 420/429

[56] References Cited

U.S. PATENT DOCUMENTS

| | | | |
|---|---|---|---|
| 4,294,608 | 10/1981 | Sedlak et al. | 75/0.5 AB |
| 4,397,682 | 8/1983 | Watanabe et al. | 75/0.5 AB |

FOREIGN PATENT DOCUMENTS

| | | | |
|---|---|---|---|
| 0023004 | 2/1986 | Japan | 75/0.5 AB |
| 0023006 | 2/1986 | Japan | 75/0.5 AB |
| 1270222 | 11/1986 | Japan | 75/0.5 AB |

*Primary Examiner*—Upendra Roy

*Attorney, Agent, or Firm*—Donald R. Castle; L. Rita Quatrini

[57] ABSTRACT

A process is disclosed for producing molybdenum-ruthenium metal powder which comprises forming an ammonium molybdate solution, heating that solution to drive off excess ammonia, and thereafter adding ruthenium dioxide to that heated ammonium molybdate solution to form a slurry of ruthenium dioxide in the ammonium molybdate solution. Molybdenum trioxide and ruthenium dioxide are then crystallized from the slurry to produce a uniform mixture of molybdenum trioxide and ruthenium dioxide which is heated at a temperature of from about 300° C. to about 800° C. for a sufficient time in a reducing atmosphere to reduce the molybdenum trioxide and ruthenium dioxide to their respective metals and form a uniform mixture of the metals. The metal mixture is heated at a temperature of from about 800° C. to about 1200° C. for a sufficient time in a reducing atmosphere to stabilize the mixture at a particle size of −325 mesh, and then cooled in a non-reacting atmosphere.

5 Claims, No Drawings

PROCESS FOR PRODUCING MOLYBDENUM-RUTHENIUM METAL POWDER

This invention relates to a process for producing molybdenum-ruthenium metal powder in a uniform distribution wherein the size of the metal particles is −325 mesh.

BACKGROUND OF THE INVENTION

Molybdenum-ruthenium metal powder is used as a high temperature braze for molybdenum parts. The most typical compositions are from about 35% to about 45% by weight Ru and the balance Mo. The critical aspect of the braze is to have a uniform composition in the powder such that melting occurs uniformly over a very narrow temperature range throughout the braze. In the past, blends of fine pure Mo powder and pure Ru powder were made. Brazes made using this method tend to be nonuniform in composition resulting in melting occurring at different temperatures within a braze. A second method is to blend −325 mesh Ru powder with $MoO_3$ and reduce the mixture at 1200° C. After reduction the coarse powder is then milled to produce a −325 mesh material. This process is very time consuming and gives poor yields, although the product is acceptable.

SUMMARY OF THE INVENTION

In accordance with one aspect of this invention, there is provided a process for producing molybdenum-ruthenium metal powder which comprises forming an ammonium molybdate solution, heating that solution to drive off excess ammonia, and thereafter adding ruthenium dioxide to that heated ammonium molybdate solution to form a slurry of ruthenium dioxide in the ammonium molybdate solution. Molybdenum trioxide and ruthenium dioxide are then crystallized from the slurry to produce a uniform mixture of molybdenum trioxide and ruthenium dioxide which is heated at a temperature of from about 300° C. to about 800° C. for a sufficient time in a reducing atmosphere to reduce the molybdenum trioxide and ruthenium dioxide to their respective metals and form a uniform mixture of the metals. The metal mixture is heated at a temperature of from about 800° C. to about 1200° C. for a sufficient time in a reducing atmosphere to stabilize the mixture at a particle size of −325 mesh, and then cooled in a non-reacting atmosphere.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The present invention provides a process for co-reducing ruthenium dioxide and molybdenum trioxide by taking molybdenum trioxide out of solution around ruthenium dioxide and thereafter co-reducing this oxide mixture. The result is a uniform mixture of ruthenium and molybdenum metals. Reduction conditions are designed to result in reduction of the two metals and to produce a particle size of −325 mesh.

The first step in the process is to form an ammonium molybdate solution. This can be done by any known method. The most typical method for forming the ammonium molybdate solution, although the invention is not limited to such is to dissolve molybdenum trioxide in ammonia. For example, pure grade molybdenum trioxide is put into solution by progressive addition of the oxide to a solution containing about 10% by volume ammonium hydroxide and about 90% water with constant agitation. Once all the molybdenum trioxide is in solution, it is heated to greater than about 65° C. to drive off excess ammonia. The ruthenium dioxide is added to the solution with agitation to form a slurry.

The amounts of molybdenum trioxide and ruthenium dioxide are that which would be needed to result in the desired molybdenum and ruthenium content in the metal mixture. For example, a mixture in weight percents of about 32 $RuO_2$ and about 68 $MoO_3$ would result in a metal blend in weight percents of about 35 Ru and about 65 Mo, and a mixture of about 47 $RuO_2$ and about 53 $MoO_3$ would result in a blend of about 50 Ru and about 50 Mo. The preferred conposition of the metal mixture is from about 35% to about 50% by weight Ru and the balance Mo.

Molybdenum trioxide and ruthenium dioxide are then crystallized from the slurry. This can be done by methods known in the art such as spray drying or evaporative crystallization.

In accordance with a preferred embodiment, the slurry is taken to dryness with agitation. A vycor or stainless steel container is preferably used for this operation. The evaporation to dryness produces a uniform mixture of molybdenum trioxide and ruthenium dioxide. The weight of the mixture can be greater than the weight of the two oxides because the mixture can contain some ammonia. This is not a problem since the ammonia is liberated during the subsequent reduction step.

The resulting oxide mixture is then subjected to a first stage heating at a temperature of from about 300° C. to about 800° C. and preferably from about 400° C. to about 600° C. for a sufficient time which is usually from about 5 hours to about 20 hours in a reducing atmosphere, preferably hydrogen, to reduce the molybdenum trioxide and the ruthenium dioxide to molybdenum metal and ruthenium metal respectively and form a uniform mixture of the metals. At the preferred temperature range, the time is from about 12 hours to about 18 hours. Since ruthenium dioxide reduces more readily than molybdenum trioxide, the above temperatures are critical so that both oxides are reduced without vaporization and to insure that the final mixture after the subsequent second stage heating is −325 mesh. Material reduced at a first stage temperature of above about 800° C. does not all pass through a 325 mesh sieve. The material reduced below about 700° C. passes through a 325 mesh sieve when the powder agglomerates are partially broken up by using Mo washers as screening aids.

The mixture of metals is then subjected to a second stage of heating at a temperature of from about 800° C. to about 1200° C. for a sufficient time in a reducing atmosphere preferably hydrogen to stabilize the −325 mesh particle size in the mixture from spontaneous combustion on exposure to air. The preferred temperature range is from about 800° C. to about 1000° C. The preferred lengths of time of heating are from about 1 hour to about 4 hours at the preferred temperatures.

The heated metal mixture is then cooled in a non-reacting atmosphere such as hydrogen and/or nitrogen, preferably nitrogen.

In accordance with a most preferred embodiment, the following schedule is given which when followed consistently gives a chemically mixed $RuO_2$—$MoO_3$ mixture and a Ru—Mo metal powder of −325 mesh size.

| SMALL SCALE CHARGE | |
|---|---|
| 1. | Temperature - Time of reduction |
| | a. Stage 1: 500° C.- 6.75 hr |
| | b. 0.25 hour to heat to 800° C. |
| | c. Stage 2: 800° C. - 1.0 hr |
| 2. | 25 gm boat load - depth 0.75" |
| 3. | 50 cfh $H_2$ flow |
| 4. | Cooling cycle in water cooled zone |
| | a. 1 hr in $H_2$ |
| | b. 1 hr in $N_2$ |

| Large Scale Charge | |
|---|---|
| 1. | Temperature - Time of reduction |
| | a. Stage 1: 500° C. - 17 hr |
| | b. 1.0 hour to heat to 800° C. |
| | c. Stage 2: 800° C. - 1.0 hr |
| 2. | 300–500 gm boat load - 1.0" bed depth |
| 3. | 50 cfh $H_2$ flow |
| 4. | Cooling cycle in water cooled zone |
| | a. 1 hr in $H_2$ |
| | b. 1 hr in $N_2$ |

Table 1 gives the results of the two stages of reduction and heating on the oxides and mixtures of the oxides.

TABLE 1

| # | Material | Stage 1 Temp - Time °C. Hr | Stage 2 | Percent Reduction | Percent −325 mesh |
|---|---|---|---|---|---|
| 1 | $MoO_3$ | 982-3 | — | 100 | <80 |
| 2 | $MoO_3$ | 700-3 | — | 100 | >99 |
| 3 | $MoO_3$ | 600-3 | — | 100 | >99 |
| 4 | $MoO_3$ | 500-67 | — | 100 | >99 |
| 5 | $MoO_3$ | 500-3 | — | 78 | |
| 6 | $MoO_3$ | 500-14 | — | 100 | >99 |
| 7 | $RuO_2$ | 600-20 | — | 100 | >99 |
| 8 | $MoO_3$—$RuO_2$ | 500-96 | 700-6.5 | 100 | >99 |
| 9 | $MoO_3$—$RuO_2$ | 600-96 | — | 100 | >99 |
| 10 | $MoO_3$—$RuO_2$ | 500-6.75 | 700-1 | 100 | >99 |
| 11 | $MoO_3$—$RuO_2$ | 500-6.75 | 800-1 | 100 | >99 |
| 12 | $MoO_3$—$RuO_2$ | 500-17 | 800-1 | 100 | >99 |

It can be seen that the material reduced and heated according to the conditions of the present invention passes through a 325 mesh sieve.

To more fully illustrate this invention, the following non-limiting example is presented.

EXAMPLE

A mixture of molybdenum trioxide and ruthenium dioxide is formed by evaporating a slurry of ruthenium dioxide in an ammonium molybdate solution to dryness or by spray drying. About 25 g of the oxide mixture is introduced into a molybdenum boat to a depth of aboaut 0.75" and reduced in hydrogen gas at about 50 cfh at a temperature of about 500° C. for about 6.75 hour. The material is then brought up to a temperature of about 800° C. over a period of about 0.25 hour and then heated to about 800° C. for about 1.0 hour. The material is then cooled for about 1 hour in $H_2$ and then for about 1 hour in $N_2$.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing molybdenum-ruthenium metal powder, said process comprising:

(a) forming an ammonium molybdate solution;

(b) heating said ammonium molybdate solution to drive off excess ammonia;

(c) adding ruthenium dioxide to the resulting heated ammonium molybdate solution to form a slurry of said ruthenium dioxide in said heated ammonium molybdate solution;

(d) crystallizing molybdenum trioxide and ruthenium dioxide from said slurry;

(e) heating said oxide mixture at a temperature of from about 300° C. to about 800° C. for a sufficient time in a reducing atmosphere to reduce said molybdenum trioxide and said ruthenium dioxide to molybdenum metal and ruthenium metal respectively and form a uniform mixture of said metals;

(f) heating said mixture of said metals at a temperature of from about 800° C. to about 1200° C. for a sufficient time in a reducing atmosphere to stabilize said mixture at a particle size of −325 mesh; and (g) cooling said heated metal mixture in a non-reacting atmosphere.

2. A process of claim 1 wherein the composition of said metal mixture is from about 35% to about 50% by weight ruthenium and the balance molybdenum.

3. A process of claim 1 wherein said oxide mixture is reduced at a temperature of from about 400° C. to about 600° C. for a period of time of from about 12 hours to about 18 hours.

4. A process of claim 3 wherein said metal mixture is heated at a temperature of from about 800° C. to about 1000° C. for a period of time of from about 1 hours to about 4 hours.

5. A process of claim 4 wherein said metal mixture is heated in hydrogen, followed by cooling to room temperature in nitrogen.

* * * * *